US006543665B1

(12) United States Patent
Farrell et al.

(10) Patent No.: US 6,543,665 B1
(45) Date of Patent: Apr. 8, 2003

(54) POWER ACTUATED TOOLS

(75) Inventors: Simon Alexander Farrell, Glen Waverley (AU); Ian Ross Ferrier, Wantirna South (AU); Silviu Greenhill, Beutleigh (AU)

(73) Assignee: Cetram PTY Limited, Victoria (AU)

( * ) Notice: Subject to any disclaimer, the term of this patent is extended or adjusted under 35 U.S.C. 154(b) by 0 days.

(21) Appl. No.: 09/857,899

(22) PCT Filed: Dec. 8, 1999

(86) PCT No.: PCT/AU99/01097

§ 371 (c)(1),
(2), (4) Date: Sep. 20, 2001

(87) PCT Pub. No.: WO00/35638

PCT Pub. Date: Jun. 22, 2000

(30) Foreign Application Priority Data

Dec. 14, 1998 (AU) ..... PP7705

(51) Int. Cl.[7] ..... B25C 1/14
(52) U.S. Cl. ..... 227/10; 227/9; 227/11
(58) Field of Search ..... 227/9, 10, 11, 227/130; 173/162.1

(56) References Cited

U.S. PATENT DOCUMENTS

| | | | | | |
|---|---|---|---|---|---|
| 3,804,314 | A | * | 4/1974 | Gilbert | 227/10 |
| 3,915,242 | A | * | 10/1975 | Bell | 173/206 |
| 3,981,424 | A | * | 9/1976 | Maier | 227/10 |
| 4,077,556 | A | * | 3/1978 | Buchel | 227/10 |
| 4,883,213 | A | * | 11/1989 | Almeras | 227/10 |
| 4,941,391 | A | | 7/1990 | Ehmig et al. | |
| 5,048,740 | A | * | 9/1991 | Beton | 227/10 |
| 5,269,450 | A | * | 12/1993 | Popovich et al. | 173/211 |
| 5,273,198 | A | * | 12/1993 | Popovich et al. | 227/10 |
| 5,332,140 | A | * | 7/1994 | Almeras et al. | 227/10 |
| 5,429,291 | A | * | 7/1995 | Thompson | 227/10 |
| 5,538,172 | A | * | 7/1996 | Jochum et al. | 173/212 |
| 6,039,229 | A | * | 3/2000 | Pfister et al. | 227/10 |
| 6,053,388 | A | * | 4/2000 | Pfister et al. | 227/10 |
| 6,123,242 | A | * | 9/2000 | Kersten | 173/212 |

FOREIGN PATENT DOCUMENTS

| | | |
|---|---|---|
| DE | 19 805 442 | 8/1999 |
| WO | 89/00483 | 1/1989 |

* cited by examiner

*Primary Examiner*—Scott A. Smith
*Assistant Examiner*—Chukwurah Nathaniel
(74) *Attorney, Agent, or Firm*—Lowe Hauptman Gilman & Berner, LLP

(57) ABSTRACT

A power actuated tool for driving a fastener such as a pin into a substrate such as steel or concrete comprises a driving piston (6) which is driven forwardly within the barrel (4) of the tool upon firing and is automatically reset in response to cocking of the tool prior to the subsequent firing. Resetting of the piston takes place by thrusting the piston (6) rearwardly during cocking by means of a spring-loaded gripper device (14) energized during cocking.

19 Claims, 3 Drawing Sheets

POWER ACTUATED TOOLS

FIELD OF THE INVENTION

The present invention relates to power actuated tools and more particularly to explosively actuated tools for driving a fastener such as a pin into a substrate such as concrete or steel.

BACKGROUND

Explosively actuated tools for driving a fastener such as a pin into a substrate such as concrete or steel conventionally comprise a driving piston which is driven forwardly along the barrel of the tool upon detonation of an explosive charge to drive into the substrate a fastener within the forward end of the barrel. After the firing stroke has been completed, the driving piston is within the forward end of the barrel and appropriate action must be taken to reset the piston into a rear position within the barrel in preparation for the next driving stroke. This may be achieved by a manual action by the operator. One method of manually resetting the piston which is widely used in practice involves the operator drawing the barrel forwardly from the housing of the tool while the piston is restrained so that the piston lies within a rear part of the barrel which is then retracted manually back into the housing.

There have been proposals for automatic or semi-automatic resetting of the piston. One such proposal involves the use of the explosive gas generated on firing the tool to drive the piston back into its rear position within the barrel after firing. Such a system can however lead to safety problems as the ducting of the explosive gas to a piston return mechanism can result in accumulation of unburnt explosive powder within the mechanism. Further, the problem arising from unburnt residues may be compounded if the tool is not used shortly after resetting of the piston and is subject to rough handling or vibration, for example by being transported on the floor of a truck whereby the previously reset piston can move out of its predetermined rear position leading to loss of power and possible generation of increasing amounts of unburnt residue at the next firing action.

SUMMARY OF THE INVENTION

Explosively actuated fastener driving tools of the type to which the present invention relates conventionally comprise a safety mechanism whereby to fire the tool the firing mechanism must be cocked by pushing the forward end of the barrel against the substrate, this causing the barrel to retract through a limited distance into the housing of the tool and this movement, in turn, cocks the tool and enables firing of the tool. This safety mechanism is designed to ensure that the tool can only be fired in its operative position pressed against the substrate and the cocking mechanism responsive to the retraction of the barrel within the tool housing is well known per se to those skilled in this art. The present invention utilises the relative movement between the barrel and housing which occurs when the barrel is pressed against the substrate on cocking also to effect resetting of the piston into its rear position.

According to the present invention there is provided a power actuated tool for driving a fastener into a substrate such as steel or concrete, said tool comprising a housing, a barrel mounted within the housing, and a piston displaceable within the barrel upon firing of the tool to drive a fastener from the forward end of the barrel into the substrate, at least a forward end of the barrel being mounted for axial movement relative to the housing whereby firing of the tool requires the forward end of the barrel to be pressed against the substrate to cause retraction of the forward end of the barrel relative to the tool housing, said tool further comprising piston resetting means responsive to retraction of the forward end of the barrel relative to the tool housing prior to firing the tool to cause displacement of the piston rearwardly relative to the barrel in preparation for that firing. Advantageously, said piston resetting means comprises means engagable with the piston in its forward position, an energy source charged with energy by the relative displacement of the forward end of the barrel inwardly relative to the housing, and means for releasing energy stored in said energy source whereby said stored energy drives the engagement means rearwardly to thereby drive the piston rearwardly relative to the barrel.

In a preferred embodiment the energy source comprises a spring in which potential energy is stored by the relative displacement between the barrel and housing and said potential energy is suddenly released to drive the piston rearwardly. Preferably the spring is a coil spring although other forms of spring such as an elastomeric spring or gas spring may alternatively be used.

In a preferred embodiment the engagement means is operative to releasably grip the piston and sudden release of the spring energy imparts a certain rearwards movement to the gripping means to impart a sudden thrust to the piston, the gripping means then releasing from gripping engagement with the piston at the end of rearwards movement of the gripping means whereby the momentum of the piston propels it further rearwardly into its rearmost position in the barrel.

Preferably piston retention means are provided to retain the piston in its rearmost position prior to firing the tool, said retention means acting in response to rebound of the piston from its rearmost position as a result of the sudden thrust used to effect resetting.

Further according to the invention, there is provided a power actuated tool for driving a fastener into a substrate such as steel or concrete, said tool comprising a housing, a barrel mounted within the housing, and a piston displaceable within the barrel upon firing of the tool to drive a fastener from the forward end of the barrel into the substrate, at least a forward end of the barrel being mounted for axial movement relative to the housing such that cocking of the tool to effect firing requires the forward end of the barrel to be pressed against the substrate to cause retraction of the forward end of the barrel relative to the tool housing, said tool further comprising piston resetting means responsive to cocking of the tool to reset the piston to the rear of the barrel in preparation for the firing, said resetting means comprising a spring-loaded gripper device energised during cocking to grip the piston and thrust the piston rearwardly.

Still further according to the invention, there is provided a power actuated tool for driving a fastener such as a pin into a substrate such as steel or concrete, said tool comprising a driving piston which is driven forwardly within a barrel of the tool upon firing, and means for automatically resetting the piston to the rear of the barrel in response to cocking of the tool prior to the subsequent firing.

BRIEF DESCRIPTION OF THE DRAWINGS.

An embodiment of the invention will now be described, by way of example only, with reference to the accompanying drawings in which.

DETAILED DESCRIPTION OF THE DRAWINGS

Figure 1:
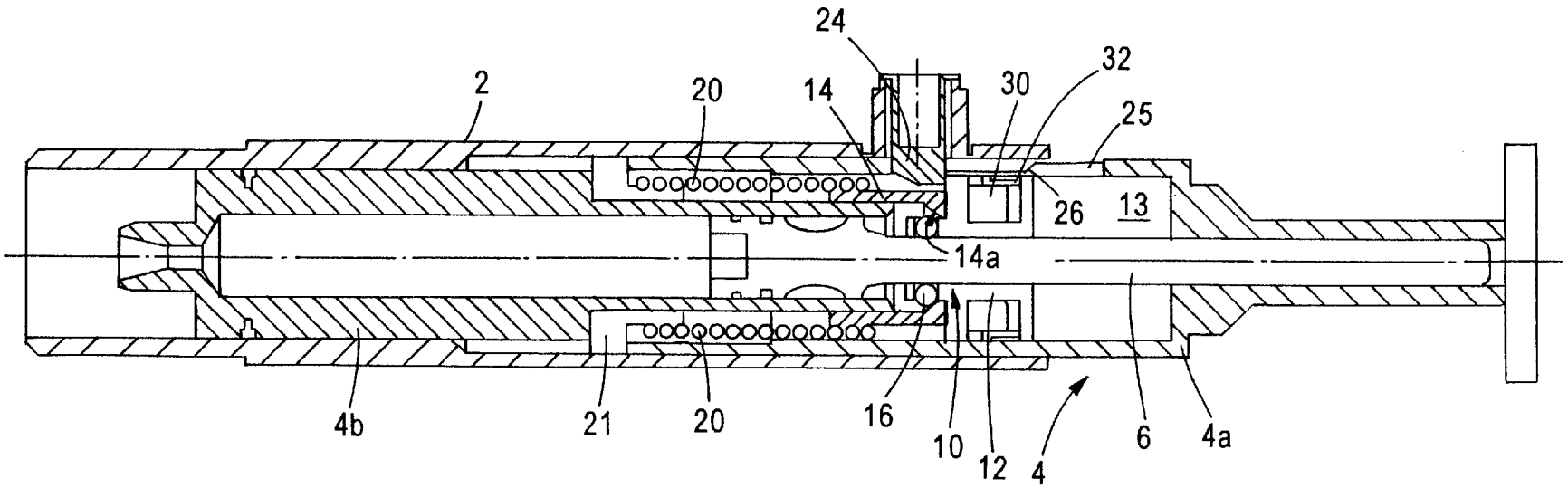
FIG. 1 is a longitudinal section showing schematically the housing, barrel, and piston of an explosively actuated tool in accordance with a preferred embodiment of the invention, the components being shown in an at rest condition following firing of the tool.
Figure 2:
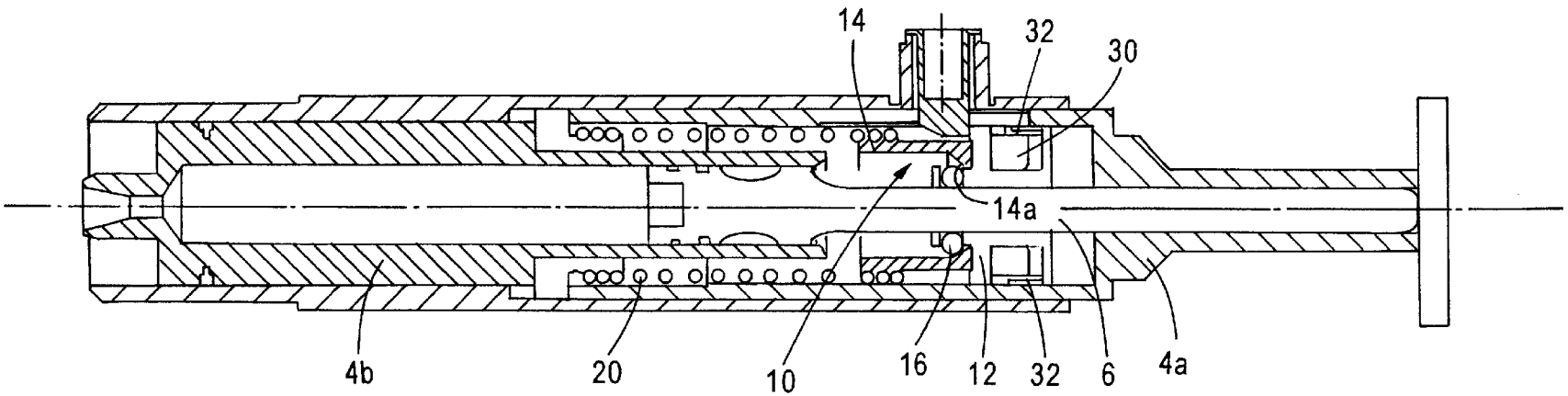
FIG. 2 is a section similar to FIG. 1 but showing the components during cocking of the tool.
Figure 3:
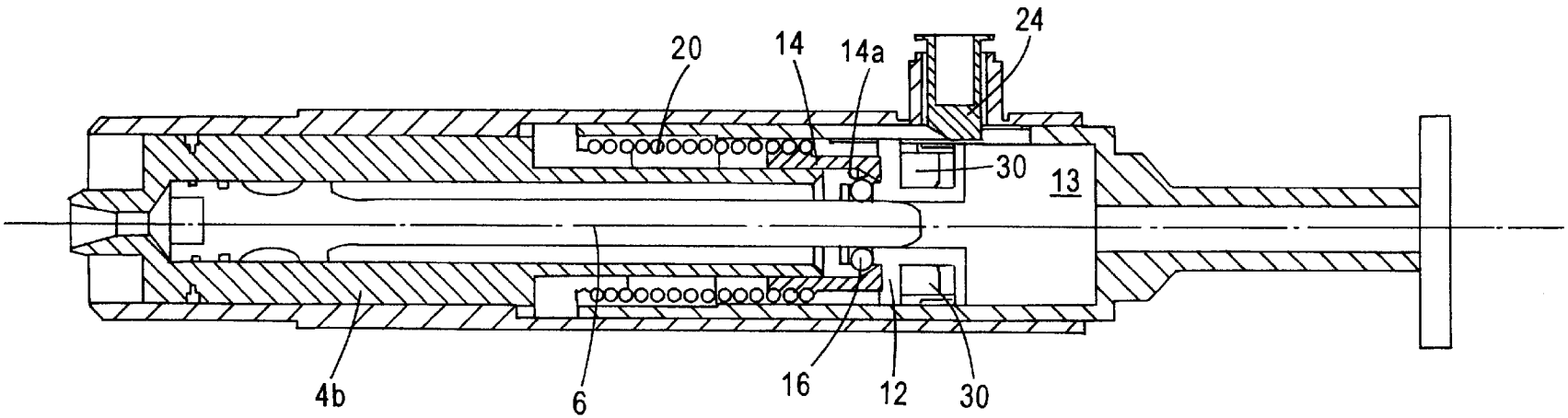
FIG. 3 is a section similar to FIG. 1 and showing the components at the end of cocking with the piston having been reset into the rear end of the barrel.

The accompanying drawings show, schematically, the outer housing 2 of the explosively actuated tool and a barrel 4 which is mounted for axial displacement within the housing between a forward position as shown in FIG. 1 and a rear position as shown in FIGS. 2 and 3 assumed on cocking when the forward end of the barrel 4 is pressed, against the substrate as previously described. The barrel 4 is formed from a front barrel part 4*a* and a rear barrel part 4*b*, the two parts being interconnected so that they move in unison within the housing 2. The barrel 4 is urged into its forward position relative to the housing 2 by a spring (not shown) and retraction of the forward end of the barrel 4 into the housing 2 on cocking is against the bias of that spring. Other components of the tool such as the cocking and trigger mechanism and the charge chamber formed at the rear end of the barrel when in its rear position are conventional and are not shown in the present drawings. The barrel 4 contains a piston 6 which is driven by detonation of the explosive charge from a rear position within the barrel 4 to a forward position in order to drive into the substrate a fastener within the forward end of the barrel 4 as is conventional.

In accordance with the preferred embodiment of the present invention, the barrel 4 houses within its forward end a piston return and retention mechanism 10 comprising a main body 12 mounted for axial movement within an enlarged chamber 13 formed between the front and rear parts of the barrel 4. The main body 12 has an internal bore aligned with the axis of the barrel 4 and of a diameter corresponding to that of the front barrel part 4*a* whereby the forward end of the piston 6 can extend through the body 12 into the front barrel part 4*a*. The body 12 carries at its rear end a gripping clutch comprising a sleeve 14 with a conical inner surface 14*a* which co-operates with balls 16 radially movable and held captive within radial passages in the rear part of the body 12 whereby the balls 16 can engage the outer surface of the part of the piston 6 within the body 12. The sleeve 14 is mounted on the body 12 for axial movement relative thereto over a restricted distance, in practice about 0.5 mm, whereby rearwards movement of the sleeve 14 relative to the body 12 causes interaction between its conical surface 14*a* and the balls 16 so as to urge the balls 16 radially inwardly into tight gripping engagement with the part of the piston 6 in contact therewith. It is to be noted that when the sleeve 14 is in its forwardmost position relative to the body 12 its conical surface 14*a* does not urge the balls 16 into gripping engagement with the piston 6. The sleeve 14 is linked by a coiled tension spring 20 to a bracket 21 formed on the body of the rear barrel part 4*b* further towards its rear end. In the "at rest" condition of FIG. 1 the spring 20 is not under tension and the sleeve 14 is in its forwardmost position relative to the body 12.

The tool housing 2 carries a locking catch 24 which is spring-biased to extend through a longitudinal slot 25 in the front barrel part 4a into the chamber 13 so as to interact with the body 12. Considering now the configuration as shown in FIG. 1 in which the barrel 4 is in its extended position prior to cocking and the piston 6 is in its forwardmost position assumed at the end of the previous firing stroke, the rear face of the body 12 is located forwardly of the spring-loaded catch 24 and the tension spring 20 is in a relaxed condition. When the tool is being cocked by pressing the forward end of the barrel 4 against the substrate in preparation for the next firing, the barrel 4 retracts into the housing 2 (FIG. 2) but the body 12 and associated gripping clutch are not displaced axially relative to the housing 2 due to the constraint imposed by the spring-loaded catch 24 and, accordingly, the barrel 4 displaces relative to the body 12, this displacement being provided for by the size of the chamber 13 in the forward end portion of the barrel 4. This displacement between the barrel 4 and body 12 results in tensioning of the spring 20 the rear end of which is attached to the barrel 4 whereby also the gripping balls 16 grip tightly onto the part of the piston 6 within the body 12 due to the interaction of the balls 16 with the conical surface 14a; of course at this stage the piston 6 is not displaced rearwardly as the body 12 and associated gripping clutch are restrained against movement by the catch 24.

As the barrel 4 reaches the innermost limit of its retraction into the housing 2 on cocking and the tension spring 20 reaches its maximum loading, a release member in the form of a ramp 26 (see FIG. 1) formed within the axial slot 25 in the barrel 4 through which the catch 24 extends engages a corresponding ramp (not shown) on the catch 24 and raises the catch 24 out of its restraining engagement with the rear face of the body 12 whereby the body 12 and gripping clutch will be drawn rapidly rearwardly within the barrel chamber 13 by the force stored within the tension spring 20. Due to the gripping action exerted between the gripping balls 16 and piston 6, the piston 6 will likewise be rapidly projected rearwardly. When the body 12 and associated gripping clutch mechanism is in its rearmost position within the chamber 13, this position being defined by engagement of the body 12 against the front face of the rear barrel part 4 (see FIG. 3) the tension spring 20 is in its relaxed state and slight forwards axial displacement between the sleeve 14 and body 12 will release the gripping constraint imposed by the balls 16 on the piston 6 whereby the momentum already imparted to the piston 6 will drive the piston 6 further rearwardly relative to the body 12 and gripping clutch which are now stationary, into its rear position within the rear barrel part 4*b* as shown in FIG. 3 in preparation for firing. In the rearmost position of the body 12 the rear end of the sleeve 14 fits over the forward end of the rear barrel part 4*b* as shown.

When, after firing, the forward end of the barrel 4 is removed from the substrate, the barrel 4 will, under its spring bias return to its forward extended position relative to the housing 2. As the barrel 4 advances forwardly relative to the housing 2, the body 12 and gripping clutch are also moved forwardly, the spring-loaded catch 24 being retained in the raised, released, position by interaction with the body 12 until, in the forward position of the barrel 4 and body 12, the configuration illustrated in FIG. 1 is again assumed. At its forward end the body 12 also carries gripping pads 30 which are subject to the action of a conical spring 32 which urges the pads 30 radially inwardly into relatively light engagement with the piston 6. The pads 30 are mounted for slight axial movement relative to the spring 32 in the body 12 whereby rearwards movement of the piston 6 relative to the body 12 as occurs during resetting of the piston 6 draws the pads slightly rearwardly within the body 12 and the pads 30 exert almost no drag on the piston 6. However upon forwards movement of the piston 6 relative to the body 12, the pads 30 are displaced forwardly relative to the conical spring 32 and thereby exert some drag on the piston 6. The restraining action provided by the pads 30 primarily comes into effect if, after the rapid rearwards movement of the piston 6, the momentum imparted to the piston 6 causes the piston 6 to rebound forwardly after engagement with the rear end of the bore in the rear barrel part 4*b*; in that event the slight forwards movement of the piston 6 which then occurs on rebound is sufficient to cause the pads 30 to grip sufficiently onto the piston 6 to prevent further forwards movement of the piston 6 following rebound. Although on firing the tool, the forwards movement of the piston 6 will again cause some gripping pressure between the pads 30 and piston 6, the retardation force imposed by the pads 30 in these circumstances will be negligible in comparison with the kinetic energy of the piston and therefore there will be virtually no diminution in the output power of the tool.

With the piston resetting system described the piston is reset automatically on cocking and as this action occurs immediately prior to firing of the tool it will be ensured that the piston is in its correct rearmost position on firing. It is also to be noted that this resetting action does not consume any of the available energy which will be generated on firing and hence will not reduce the effective power of the tool. Also it does not rely on the use of combustion gases generated on firing and hence does not face the problems previously discussed concerning possibly dangerous build-up of unburnt residue. Although the pressure applied to the tool by the operator on cocking will be greater than that applied in a corresponding tool without the resetting mechanism, for safety reasons the cocking pressure is itself quite substantial and the additional pressure needed with this tool also to effect resetting would barely be noticeable.

The embodiment has been described by way of example only and modifications are possible within the scope of the invention.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

What is claimed is:

1. A power actuated tool for driving a fastener into a substrate, said tool comprising:

a housing;

a barrel mounted within the housing;

a piston displaceable within the barrel upon firing of the tool to drive the fastener from a forward end of the barrel into the substrate, at least the forward end of the barrel being mounted for axial movement relative to the housing whereby firing of the tool requires the forward end of the barrel to be pressed against the substrate to cause retraction of the forward end of the barrel rearwardly relative to the housing; and piston resetting means responsive to retraction of the forward end of the barrel relative to the housing prior to firing the tool to cause displacement of the piston rearwardly relative to the barrel in preparation for that firing.

2. A power actuated tool for driving a fastener into a substrate, said tool comprising:

a housing;

a barrel mounted within the housing;

a piston displaceable within the barrel upon firing of the tool to drive the fastener from a forward end of the barrel into the substrate, at least the forward end of the barrel being mounted for axial movement relative to the housing whereby firing of the tool requires the forward end of the barrel to be pressed to cause retraction of the forward end of the barrel rearwardly relative to the housing; and piston resetting means responsive to retraction of the forward end of the barrel relative to the housing prior to firing the tool to cause displacement of the piston rearwardly relative to the barrel in preparation for that firing;

wherein said piston resetting means comprises:

engagement means engageable with the piston when the piston is in a forward position;

an energy source charged with energy by the relative displacement of the forward end of the barrel inwardly relative to the housing; and means for releasing energy stored in said energy source whereby said stored energy drives the engagement means rearwardly to thereby drive the piston rearwardly relative to the barrel.

3. A tool according to claim 2, wherein the energy source comprises a spring in which potential energy is stored by the relative displacement between the barrel and housing, said potential energy being suddenly released, by said means for releasing, to drive the engagement means.

4. Tool according to claim 3, wherein the spring is selected from the group consisting of a coil spring, an elastomeric spring and a gas spring.

5. A tool according to claim 2, wherein the engagement means comprises gripping means operative to releasably grip the piston; and release of the stored energy imparts a limited rearward movement to the gripping means to impart a sudden thrust to the piston, the gripping means configured to release from gripping engagement with the piston at a rearward end of the limited rearward movement whereby the momentum of the piston propels the piston further rearwardly into a rearmost position in the barrel.

6. A tool according to claim 2, further comprising piston retention means operable to retain the piston in a rearmost position prior to firing the tool, said retention means configured to act in response to rebound of the piston from the rearmost position following resetting.

7. A tool according to claim 2, wherein the engagement means comprises a body surrounding the piston and having gripping members which are thrust into gripping engagement with the piston by interaction with an inclined surface of the body upon retraction of the forward end of the barrel; and said energy source comprises a spring, linked to the body and the barrel whereby retraction of the forward end of the barrel causes energizing of said spring when the body is retained relative to the housing by releasable catch means, said catch means being releasable in response to continuing retraction movement of the barrel into the housing whereby the body of the engagement means is driven rearwardly in the housing by the spring energy to impart a rearward thrust to the piston as a result of the engagement between the gripping members and the piston.

8. A tool according to claim 7, wherein the body of the engagement means is mounted for limited rearward axial movement within the housing, the arrangement being such that, at a rear position of the limited rearward axial movement of the body within the housing, the thrust applied to the piston causes the piston to travel further rearwardly with the gripping members releasing from gripping engagement with the piston in response to rearward movement of the piston relative to the body.

9. A tool according to claim 7, wherein the releasable catch means is configured to be released by co-operation with a release member movable with the barrel.

10. A tool according to claim 2, further comprising means responsive to forwards movement of the piston within the barrel to apply a light gripping force to the piston so as substantially to minimize rebound movement of the piston from a rearmost position after resetting.

11. A power actuated tool for driving a fastener into a substrate , said tool comprising:

a housing;

a barrel mounted within the housing;

a piston displaceable within the barrel upon firing of the tool to drive the fastener from a forward end of the barrel into the substrate, at least the forward end of the barrel being mounted for axial movement relative to the housing such that cocking of the tool to effect firing requires the forward end of the barrel to be pressed to cause retraction of the forward end of the barrel rearwardly relative to the housing; and a spring-loaded gripper device responsive to cocking of the tool to reset the piston to a rear position in the barrel in preparation for the firing, said spring-loaded gripper device being energized during cocking to grip the piston and thrust the piston rearwardly.

12. A power actuated tool for driving a fastener into a substrate, said tool comprising a driving piston configured to be driven forwardly within a barrel of the tool upon firing, and resetting means for automatically resetting the piston to a rear position in the barrel in response to cocking of the tool prior to the subsequent firing.

13. A power actuated tool for driving a fastener into a substrate, said tool comprising a driving piston configured to be driven forwardly within a barrel of the tool upon firing, and a spring-loaded thrust device for automatically resetting the piston to a rear position in the barrel in response to cocking of the tool prior to the subsequent firing;

wherein the spring-loaded thrust device is energized during cocking to thrust the piston rearwardly during cocking.

14. A power actuated tool for driving a fastener into a substrate, said tool comprising:

a housing;

a barrel mounted to the housing for axial movement relative to the housing between first forward position and first rearward position;

a piston axially displaceable within the barrel between a second forward position and a second rearward position; and a resetting mechanism connecting the barrel and the piston for automatically resetting the piston from the second forward position to the second rear position in response to a cocking displacement of the barrel from the first forward position to the first rearward position.

15. A tool according to claim 14, wherein an axial distance between the first forward position and the first rearward position is shorter than that between the second forward position to the second rear position.

16. A tool according to claim 14, wherein said resetting mechanism comprises:

a connecting element having first and second portions attached to the piston and the barrel, respectively; and a catching element releasably engaging the first portion of the connecting element, wherein said catching element is configured to engage the first portion of the connecting element to hold the piston at the second forward position during the cocking displacement of the barrel from the first forward position to the first rearward position, and to release the first portion of the connecting element, and hence the piston, when the barrel has reached the first rearward position.

17. A tool according to claim 14, wherein the second portion of the connecting element is fixed to the barrel to travel with the barrel in the cocking displacement thereof, and potential energy.that is stored as the second portion travels away from the first portion during the cocking displacement is released by the catching element, when the barrel has reached the first rearward position, to drive the piston rearwardly from the second forward position to the second rearward position.

18. A tool according to claim 17, wherein the connecting element is a spring.

19. A tool according to claim 17, wherein the catching element extends through a slot formed in a wall of the barrel to engage with the first portion during the cocking displacement of the barrel, said slot having a disengaging member configured to arrive at the catching element when the barrel reaches the first rearward position and disengage the catching element from the first portion, thereby releasing the piston.

* * * * *